US006161618A

United States Patent [19]

Parks et al.

[11] Patent Number: 6,161,618

[45] Date of Patent: Dec. 19, 2000

[54] SUBSEA CONTROL MODULE

[75] Inventors: William C. Parks, Katy; J. Douglas Smith, Houston, both of Tex.

[73] Assignee: DTC International, Inc., Houston, Tex.

[21] Appl. No.: 09/369,795

[22] Filed: Aug. 6, 1999

Related U.S. Application Data

[60] Provisional application No. 60/095,604, Aug. 6, 1998.

[51] Int. Cl.[7] ..... E21B 33/035; E21B 34/04; F17D 1/08

[52] U.S. Cl. ..... 166/351; 166/338; 166/344; 137/236.1

[58] Field of Search ..... 166/351, 338, 166/344; 137/236.1

[56] References Cited

U.S. PATENT DOCUMENTS

| | | | |
|---|---|---|---|
| 3,430,670 | 3/1969 | Hopkins | 137/236.1 X |
| 3,473,605 | 10/1969 | Thuse et al. | 166/338 |
| 3,654,951 | 4/1972 | Pogonowski et al. | 137/236.1 X |
| 3,820,600 | 6/1974 | Baugh . | |
| 3,894,560 | 7/1975 | Baugh . | |
| 4,046,192 | 9/1977 | Darnborough et al. . | |
| 4,337,829 | 7/1982 | Banzoli et al. . | |
| 4,404,989 | 9/1983 | LeMoine | 137/236.1 X |
| 4,607,701 | 8/1986 | Gundersen | 166/344 X |
| 4,637,419 | 1/1987 | Hughes | 137/236.1 |
| 4,637,470 | 1/1987 | Weathers et al. | 166/344 |
| 4,643,616 | 2/1987 | Castel et al. | 166/338 X |
| 4,650,151 | 3/1987 | McIntyre | 137/236.1 X |
| 4,969,519 | 11/1990 | Kelly | 166/348 |
| 4,974,628 | 12/1990 | Tepermeister et al. | 137/454.4 |
| 5,738,142 | 4/1998 | Eike et al. | 137/596.17 |
| 6,032,742 | 3/2000 | Tomlin et al. | 166/345 |

FOREIGN PATENT DOCUMENTS

| | | |
|---|---|---|
| 987308 | 3/1965 | United Kingdom . |
| 2167469 | 5/1986 | United Kingdom . |

*Primary Examiner*—Eileen D. Lillis
*Assistant Examiner*—Jong-Suk Lee
*Attorney, Agent, or Firm*—Felsman, Bradley, Vaden, Gunter & Dillon, L.L.P.; James E. Bradley

[57] ABSTRACT

A subsea control module consists of three primary sections. The lower portion consists of a plate for carrying hydraulic couplings and hydraulic passages from valves to couplings. The lower portion contains a sub-assembly containing electro-optical couplings with direct sealed passages and wiring to a dry electronics chamber. The valve manifold has multiple pressure supply sources and a plurality of valves mounted therein. An outside portion of the valves are exposed so that the valves are externally accessible without disassembly of the subsea control module assembly, which facilitates an increase in accessibility and a reduction in maintenance times and costs. Electronics, wiring and solenoid valves are located in a one atmosphere, dry nitrogen purged chamber in a pressure vessel dome. The dry chamber has direct access to transducers and solenoid valves, thereby eliminating subsea cables. A mandrel extends below the device for engagement with a central locking mechanism in a receiver baseplate. Since the mandrel is located below the SCM rather than extending therethrough, space within the device is not occupied by the mandrel. Therefore each module is of a reduced size, which permits the retrieval and immediate replacement of the module by an ROV, which reduces the need to make several trips between the surface and subsea.

28 Claims, 4 Drawing Sheets

SUBSEA CONTROL MODULE

CROSS-REFERENCE TO RELATED APPLICATIONS

This application claims the benefits of provisional patent application Ser. No. 60/095,604, filed on Aug. 6, 1998, in the U.S. Patent & Trademark Office.

TECHNICAL FIELD

The present invention relates to subsea control modules or pods used in the subsea oil & gas industry as a local control source for subsea production trees, flow control choke valves and downhole instrumentation.

BACKGROUND OF THE INVENTION

Subsea Control Modules (SCMs) are commonly used to provide well control functions during the production phase of subsea oil and gas production. Typical well control functions and monitoring provided by the SCM are as follows: 1) Actuation of fail-safe return production tree actuators and downhole safety valves; 2) Actuation of flow control choke valves, shut-off valves, etc.; 3) Actuation of manifold diverter valves, shut-off valves, etc.; 4) Actuation of chemical injection valves; 5) Actuation and monitoring of Surface Controlled Reservoir Analysis and Monitoring Systems (SCRAMS) sliding sleeve, choke valves; 6) Monitoring of downhole pressure, temperature and flowrates; 7) Monitoring of sand probes, production tree and manifold pressures, temperatures, and choke positions.

The close proximity of the typical SCM to the subsea production tree, coupled with its electro-hydraulic design allows for quick response times of tree valve actuations. The typical SCM receives electrical power, communication signals and hydraulic power supplies from surface control equipment. The subsea control module and production tree are generally located in a remote location relative to the surface control equipment. Redundant supplies of communication signals, electrical, and hydraulic power are transmitted through umbilical hoses and cables ranging from one thousand feet to several miles in length, linking surface equipment to subsea equipment. Electronics equipment located inside the SCM conditions electrical power, processes communications signals, transmits status and distributes power to solenoid piloting valves, pressure transducers and temperature transducers.

Low flowrate solenoid piloting valves are typically used to pilot high flowrate control valves. These control valves transmit hydraulic power to end devices such as subsea production tree valve actuators, choke valves and downhole safety valves. The status condition of control valves and their end devices are read by pressure transducers located on the output circuit of the control valves. Auxiliary equipment inside the typical SCM consists of hydraulic accumulators for hydraulic power storage, hydraulic filters for the reduction of fluid particulates, electronics vessels, and a pressure/temperature compensation system.

Previous devices have used an oil-filled chamber to compensate for hydrostatic pressure increase outside of the device during use to keep seawater away from cable assemblies. An SCM is typically provided with a latching mechanism that extends through the body of the SCM and that has retractable and extendable dogs or cams thereon to engage a mating receptacle in a base plate.

SUMMARY OF THE INVENTION

The present invention is a subsea control module. The subsea control module may be used in the production phase or in other applications, including a front end of a blow-out preventer (BOP) control system. The subsea control module of the invention is preferably modularized to facilitate ease of maintenance. However, the control module of the invention may be made from a single piece. Necessary passages are machined into a solid block or a laminated manifold to replace internal tubing. The design of the present invention eliminates the need for hydraulic tubing, subsea filters and subsea accumulators internal to the subsea control module. The modular design consists of machined plates containing receptacles for cartridge control valves, passages for hydraulic supplies, electrical cables and wiring. The plates are stackable and screwed together with pressure energized seals sandwiched between layers. The modular subsea control module consists of three primary sections. The lower portion or base module consists of a plate for carrying hydraulic couplings and project specific hydraulic passages from valves to couplings. The lower plate contains a subassembly containing electro-optical couplings with direct sealed passages and wiring to the dry, one atmosphere, nitrogen filled, electronics chamber. The nitrogen filled electronics chamber enables solenoids and electronics to be located within the same chamber. Fiber optic couplings, electrical couplings, or other suitable couplings, such as a coupling that provides a mixture of electrical and optical connections may be used. Sandwiched between the lower plate and the valve module is a seal carrier plate with embedded seals. The carrier plate is replaceable as a single unit or allows the replacement of individual seals.

The valve manifold, with multiple pressure supply sources, typically 5 kpsi and 10 kpsi, consists of two layers of radially mounted valves. The valve manifold section typically remains unchanged between applications, thereby requiring only minor machining modifications for project specific pressure supplies. Externally accessible pressure latched cartridge valves are positioned around the perimeter of the subsea control module, which facilitates an increase in accessibility and a reduction in maintenance times and costs. In one embodiment, the cartridge valves are arranged radially around the SCM. In an alternate embodiment, the cartridge valves are arranged in a square configuration, wherein two layers are arranged in four groups of three cartridge valves that are arranged peripherally at right angles. However, other embodiments and arrangements, e.g. hexagon or octagonal, are possible.

The present invention relocates the accumulators and filters to separate subsea modules and eliminates the need for a pressure/temperature compensation system and separate electronics vessel.

The electronics, wiring and solenoid valves are located in a one atmosphere, dry nitrogen purged chamber. Dry nitrogen is used in the chamber to prevent condensation from forming on the electronics. The upper dry chamber for electronics has direct access to transducers and solenoid valves, which eliminates subsea cables. A pressure vessel dome protects electronics, transducers, solenoids, and wiring. The pressure vessel dome is easily removable for maintenance and repair of electrical components. The smaller size of this type of control module allows for installation and retrieval by a remote operated vehicle (ROV), which eliminates the need for a separate running tool. When the weight of a subsea module exceeds the carrying capacity of the ROV, attachment points on the top of the modules facilitate the attachment of tow line or buoyancy modules.

Previous subsea control module designs contain a central locking mechanism that consumes valuable space. In the preferred embodiment, the present invention relocates the central locking mechanism to the receiver baseplate. A axial mandrel is provided on an underside of the subsea control module (SCM) that extends below the SCM for passive engagement with the locking mechanism. The locking mechanism is over-ridable, retrievable and installable by an ROV in the event of malfunction or need of repair. Other locking mechanisms contained within the SCM are also possible. The reduced size of this type of control module permits the retrieval and immediate replacement of the control module by an ROV, which reduces the need to make several trips between the surface and subsea. The above features drastically reduce down-time and operation expenses by requiring only a single ROV deployment vessel for installation, retrieval and maintenance operations.

DETAILED DESCRIPTION OF THE INVENTION

Figure 1:
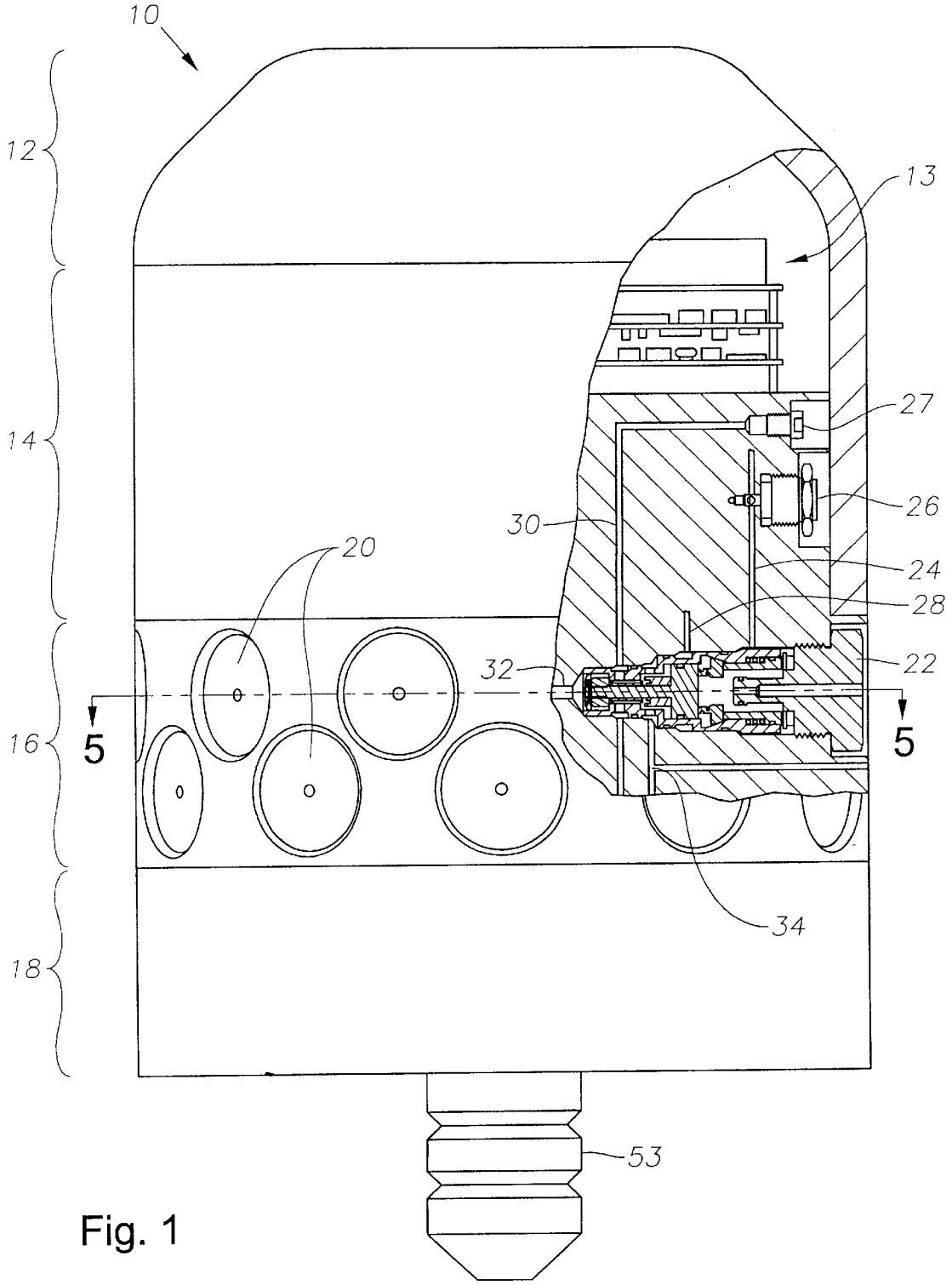
FIG. 1 is a partial sectional view of a subsea control module.

A modular subsea control module designated generally 10 is shown in FIG. 1. In the preferred embodiment, subsea control module 10 includes a pressure dome 12, a pilot module 14 enclosed by dome 12, a valving module 16 and a base module 18. Pressure dome 12 may be elliptical, hemispherical, or other suitable shape. Pressure dome 12 houses electronics 13.

The valving module 16 has a plurality of machined cartridge control valve receptacles 20. Cartridge control valves 22 are positioned within receptacles 20 (FIG. 1). A valve opening pilot passage 24 communicates cartridge control valve 22 with solenoid pilot valve 26. The cartridge control valve 22 is a two position main stage hydraulic valve that uses two pilot passages, i.e. valve opening pilot passage 24 and valve closing pilot passage 28. Pilot passages 24, 28 are each in communication with a solenoid valve. The solenoid valves are sequentially energized to flip the main stage back and forth between each of two positions. Also machined into valving module 16 is a vent port 34, an output port 30, and a supply port 32. Output port 30 communicates with pressure transducer 27.

In an alternate embodiment of subsea control module 10, pilot module 14, valving module 16 and base module 18 are formed from a single piece. Cartridge valve receptacles 20 are machined into the subsea control module in straight rows that are preferably set at right angles to one another. The resulting rectangular layout of valves 22 and couplings allows the valve section to be manufactured from a drilled manifold as opposed to a laminated plate scheme.

An axial mandrel 53 extends downward from base module 18 for latching into a mating receptacle (not shown in FIG. 1) on a base plate. The subsea control module 10 may be installed and retrieved by a remote operated vehicle (ROV). Therefore, down-time and operation expenses are reduced by requiring only a single ROV deployment vessel for installation, retrieval and maintenance operations.

Figure 2:
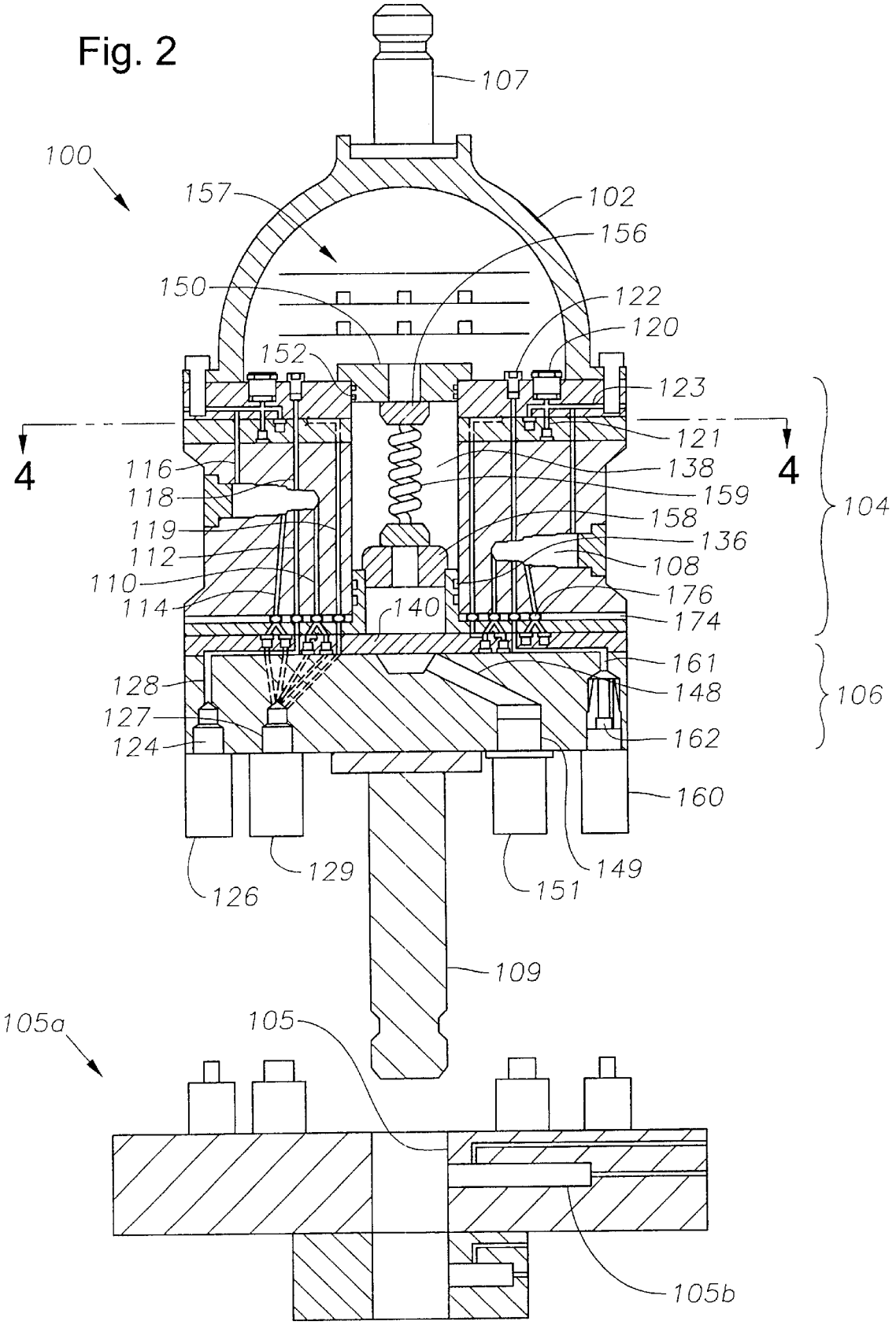
FIG. 2 is a cross-sectional elevation view of an alternate embodiment of the subsea control module of the invention.
Figure 3:
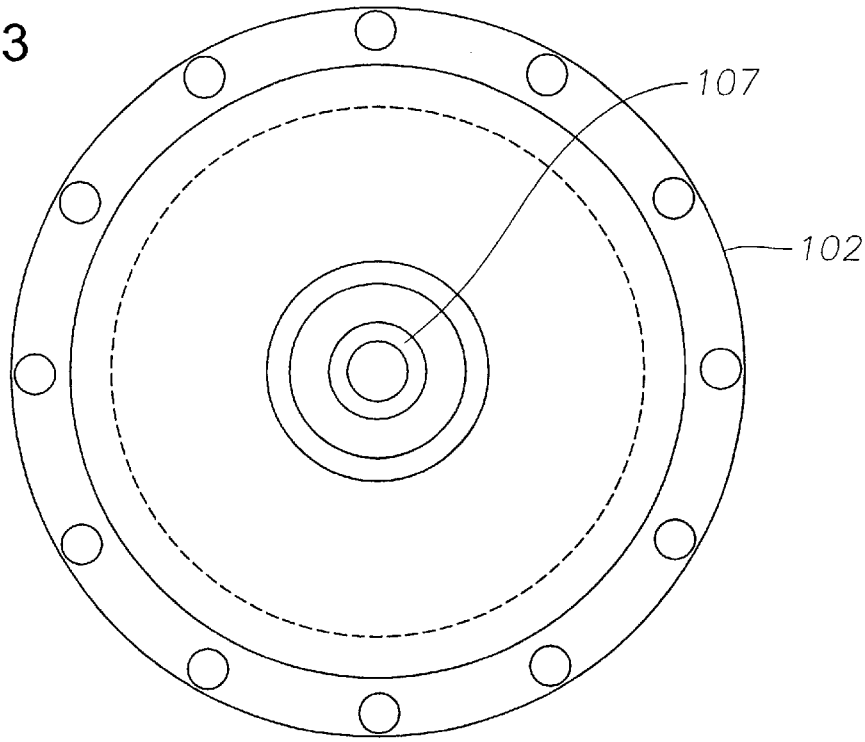
FIG. 3 is a top view of the alternate embodiment of the subsea control module of the invention.

Referring now to FIG. 2, a second embodiment 100 of the subsea control module is shown. The subsea control module 100 is made up of a pressure dome 102, a valving module 104 and a base module 106. An upwardly extending axial mandrel 107 is provided to facilitate an attachment point for a tow line or buoyancy module. A downwardly extending axial mandrel 109 is provided for latching onto a mating receptacle 105 on a base plate 105*a*.

Axial mandrel 109 does not extend into the body of subsea module 100, but is affixed to the bottom of the module 100. By providing an axial mandrel 109 that does not extend within the subsea control module 100, space within the module 100 is freed up for other uses. In a preferred embodiment, axial mandrel 109 is passive, i.e. has no active latching mechanisms, and is used to secure SCM 100 to base plate 105*a* by a latching mechanism 105*b* located within or below the base plate. In an alternate embodiment, axial mandrel 109 is provided with latching devices that are activated hydraulically or by other means.

A pressure dome 102 is designed to withstand the increased pressure that is experienced subsea. The pressure dome 102 is preferably filled with dry nitrogen at one atmosphere of pressure. The pressure dome 102 may be elliptical, hemispherical or another suitable shape that resists pressure at depth.

Figure 5:
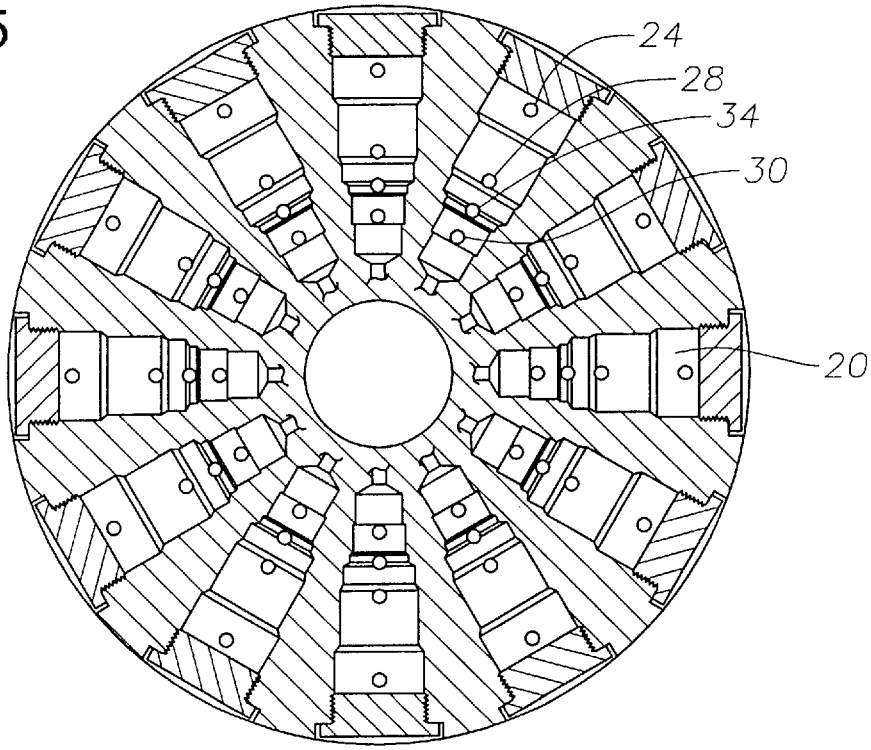
FIG. 5 is a cross-sectional view of the embodiment of the subsea control module of FIG. 1 taken along line 5—5.

Valving module 104 contains a plurality of cartridge control valve receptacles 108 for receiving cartridge control valves (not shown). The preferred cartridge valve for SCM 100 is activated to an open or closed position by a single valve pilot port 116. An outer end of the cartridge control valve receptacles 108 are exposed to the outside of valve module 104. Therefore, cartridge valves located in the cartridge control valve receptacles 108 are exposed so that the valves may be removed for repair or replacement without disassembly of the module 100. Cartridge control valve receptacles 108 are preferably oriented perpendicular to an axis of the subsea control module 100. Cartridge control valve receptacles 108 are visible in FIG. 5, which is a cross-sectional view taken along line 5—5 of FIG. 2.

Referring back to FIG. 2, a valve supply port 110, a valve function port 112, a valve vent port 114, a pilot function port 116, and a passageway 118 are machined into valving module 104 to communicate with cartridge valves (not shown), which are positioned within cartridge valve receptacles 108. Passageway 118 communicates flow from a function port 112 of a main stage of the valve to a pressure transducer 122. Additionally, a pilot vent port 119 is machined in valve module 104.

Figure 4:
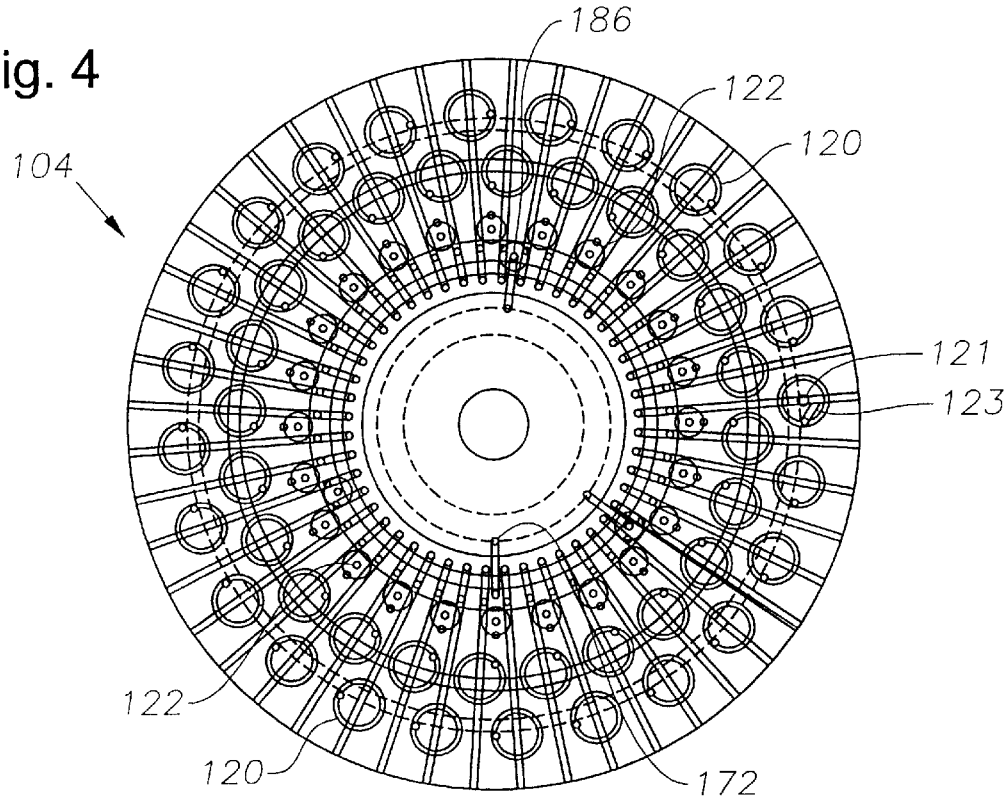
FIG. 4 is a cross-sectional view of the alternate embodiment of the subsea control module of FIG. 2 taken along line 4—4.

An upper portion of valve module 104 contains solenoid 120 and pressure transducer 122. Solenoid 120 has supply passage 121 and function passage 123. (FIG. 4). The upper portion of valve module 104 is formed as part of the valve module 104 or formed from a piece that is brazed or bonded to valve module 104 so that valve module 104 is a single piece.

Pressure source receptacles 127 are machined on a lower end of base module 106 for receiving a pressure source 129. Pressure output 126 communicates with pressure passageway 128, which communicates with valve function port 112. Incoming hydraulic port 127 is machined or formed on a lower end of base module 106 for receiving hydraulic source 129.

A seal 136 prevents liquids from entering dry chamber 138. A central recess 140 is formed within base module 106. Central recess 140 communicates with dry conduit 148. Dry conduit 148 communicates with communication port 149, which receives communication connector 151 to form an electro-optical connection. Communication port 149 and signal connector 151 may form an electrical connection, a fiber optic connection, or a connection that communicates both electrically and fiber optically.

A plug 150 is placed within an upper portion of dry chamber 138. Seals 152 prevent liquids from entering pressure dome 102 through dry chamber 138. Elastomeric seals 156 and 158 prevent liquids from making contact with wiring 159 that is positioned within dry conduit 148, within central recess 140, and which pass though dry chamber 138 before communicating with electronics 157, which are housed in a chamber defined by pressure dome 102. Pressure dome 102 is preferably filled with dry nitrogen.

Valve function port 112 provides fluid through outgoing hydraulic coupling 160. An outgoing hydraulic source port 161 is machined in the bottom of base module 106 to receive a pressure source. Hydraulic fluid flowing through outgoing hydraulic coupling 160 is used to actuate a hydraulic actuated device, such as a gate valve (not shown). A hydraulic return filter 162 is provided upstream of each outgoing source port 161. Filter 162 allows a free flow of hydraulic fluid out to the hydraulic actuated device, but filters the return fluid that passes back through the main stage hydraulic valve. Filter 162 prevents contamination and potential plugging of the valve.

Figure 6:
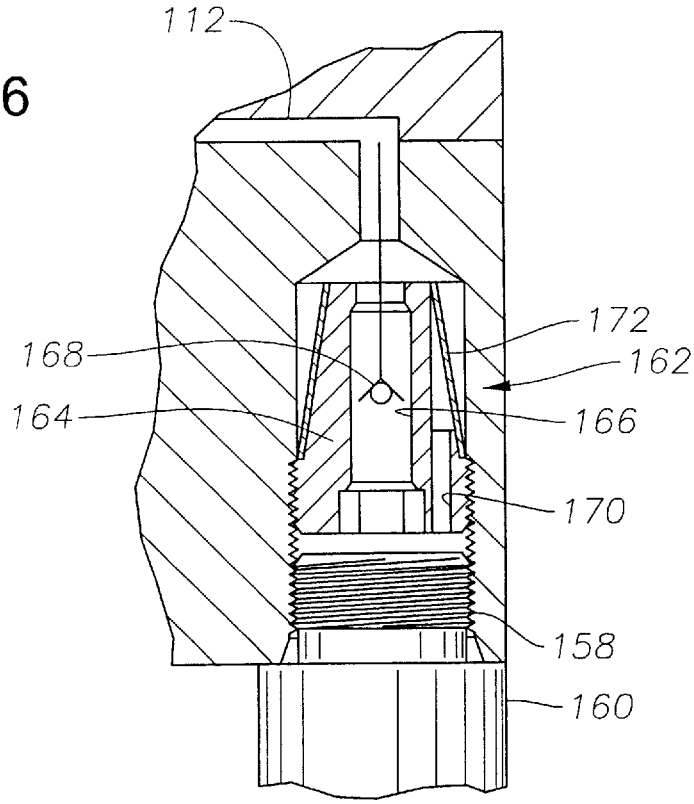
FIG. 6 is a cross-sectional view of an in-line filter shown in the subsea control module of FIG. 2.

Filter 162 is shown in greater detail in FIG. 6. Filter 162 has body 164 defining a passageway 166 with a check valve 168 located therein. Check valve 168 permits flow from a cartridge valve located in cartridge valve receptacle 108 but does not permit backflow from the downstream gate valve (not shown). Any backflow from the gate valve must flow through outer passageway 170 and through filter element 172. Filter element 172 eliminates matter from the fluid that may have been emanated from the gate valve.

Referring back to FIG. 2, seal carrier plate 174 with embedded seals 176 is sandwiched between the base module 106 and the valve module 104. The seal carrier plate 174 may be replaceable as a single unit or is designed to allow the replacement of individual seals 176. The seals 176 may be metal-to-metal seals or polymer seals that are preferably pressure energized.

FIG. 4 shows a cross-sectional top view of the valve module 104 taken along line 4—4 of FIG. 2. Pilot supply passage 180 extends radially outward from a pilot supply header. Pressure transducers 186 for the supply headers communicate with the pilot supply header 119 via passageways 188. Passageways 188, 180, 121, and 123 may be formed by a laminated manifold made up of two or more layers of suitable material bonded together. Channels may be cut into one or more layers prior to bonding to form passageways as is known in the art.

The apparatus of the invention has several advantages. By machining necessary channels into the device, the need for hydraulic tubing internal to the apparatus is eliminated. A modular valve manifold utilized in the invention requires little changes between applications. Therefore, only minor modifications for a particular application specific pressure supply is required. Externally accessible pressure latched cartridge valves facilitate an increase in accessibility and a reduction in maintenance times and costs. If the valves are arranged in a square or rectangular configuration, the valve section may be manufactured from a drilled manifold as opposed to a laminated plate scheme. The pressure dome eliminates the need for a pressure/temperature compensation system such as filling a chamber with oil.

While the invention has been shown in only one of its forms, it should be apparent to those skilled in the art that it is not so limited, but is susceptible to various changes without departing from the scope of the invention.

What is claimed is:

1. A subsea control module for coupling to a subsea well installation comprising:

a body having a longitudinal axis, a plurality of cartridge valve receptacles formed therein transverse to the axis, each of the receptacles having an entrance at an exterior side of said body, and a plurality of passageways formed in said body that communicate with said cartridge valve receptacles for communicating hydraulic fluid;

a cartridge valve in each of said cartridge valve receptacles, each cartridge valve having an exterior side at said entrance of the receptacle to enable said cartridge valves to be inserted into and removed from said receptacles from an exterior of the body;

a plurality of connectors protruding from the body, the connectors being in communication with the passageways and adapted to engage mating connectors on the subsea well installation to supply hydraulic fluid pressure to the cartridge valves and to deliver hydraulic fluid pressure controlled by the cartridge valves to components in the subsea well installation.

2. The subsea control module according to claim 1 wherein each of said receptacles has a receptacle axis that is substantially perpendicular to the longitudinal axis.

3. The subsea control module according to claim 2 wherein some of the receptacles are located at different elevations along the longitudinal axis than other of said receptacles.

4. The subsea control module according to claim 1 wherein the connectors depend from a lower side of the body.

5. The subsea control module according to claim 1 further comprising:

a plurality of solenoids in communication with said passageways for selectively providing said cartridge valves with pilot pressure to control said cartridge valves.

6. The subsea control module according to claim 1 further comprising:

a pressure dome affixed to said body, said pressure dome capable of withstanding hydrostatic pressure at depth; and a plurality of electrical components mounted to said body and electrically connected with solenoids for controlling said solenoids, said components being located within said dome.

7. The subsea control module according to claim 1 wherein:

said body comprises a valve module that contains said cartridge valve receptacles and a base module affixed thereto, the connectors being mounted to the base module.

8. A subsea control module for coupling to a subsea well installation comprising:

a body having a longitudinal axis, a plurality of cartridge valve receptacles formed therein transverse to the axis, each of the receptacles having an entrance at an exterior side of said body, and a plurality of passageways formed in said body that communicate with said cartridge valve receptacles for communicating hydraulic fluid;

a cartridge valve in each of said cartridge valve receptacles, each cartridge valve having an exterior side at said entrance of the cartridge valve receptacle to enable said cartridge valves to be inserted into and removed from said receptacles from an exterior of the body;

a plurality of connectors protruding from a lower side of the body, the connectors being in communication with the passageways and adapted to engage mating connectors on the subsea well installation to supply hydraulic fluid pressure to the cartridge valves and to deliver hydraulic fluid pressure controlled by the cartridge valves to components in the subsea well installation;

a plurality of solenoids in communication with said passageways for selectively providing said cartridge valves with pilot pressure to control said cartridge valves;

a pressure dome affixed to said body, said pressure dome capable of withstanding hydrostatic pressure at depth; and a plurality of electrical components mounted to said body and electrically connected with said solenoids for controlling said solenoids, said electrical components being located within said dome.

9. The subsea control module according to claim 8 wherein:

said passageways include a vent port, an output port, and a supply port joining each of the cartridge valve receptacles, wherein the supply and output ports lead to the connectors.

10. The subsea control module according to claim 8 wherein:

said pressure dome is filled with dry nitrogen to protect said electrical components in said pressure dome from condensation.

11. The subsea control module according to claim 8 wherein:

said pressure dome is filled with dry nitrogen to protect said electrical components in said pressure dome from condensation, and wherein said dry nitrogen is substantially at one atmosphere of pressure.

12. The subsea control module according to claim 8 wherein:

said pressure dome is generally ellipsoid in shape.

13. The subsea control module according to claim 8 wherein:

said pressure dome is generally hemispherical in shape.

14. The subsea control module according to claim 8 wherein:

said cartridge valve receptacles have axes substantially perpendicular to the longitudinal axis of the subsea control module.

15. The subsea control module according to claim 8 wherein:

at least one of said connectors comprises an outgoing port for delivering hydraulic fluid pressure to the subsea well installation and wherein at least one filter is upstream of said output port within one of said passageways; and a check valve incorporated within said filter that allows free flow of fluid out of said subsea control module but filters any returning fluid.

16. A subsea control module for coupling to a subsea well installation comprising:

a body having a longitudinal axis, a plurality of cartridge valve receptacles formed therein transverse to the axis, each of the receptacles having an entrance at an exterior side of said body, and a plurality of passageways formed in said body that communicate with said cartridge valve receptacles for communicating hydraulic fluid;

a cartridge valve in each of said cartridge valve receptacles, each cartridge valve having an exterior side at said entrance of the cartridge valve receptacle to enable said cartridge valves to be inserted into and removed from said cartridge valve receptacle from an exterior of the body;

a plurality of connectors protruding from a lower side of the body, the connectors being in communication with the passageways and adapted to engage mating connectors on the subsea well installation to supply hydraulic fluid pressure to the cartridge valves and to deliver hydraulic fluid pressure controlled by the cartridge valves to components in the subsea well installation;

a plurality of solenoids in communication with said passageways for selectively providing said cartridge valves with pilot pressure to control said cartridge valves;

a pressure dome affixed to said body, said pressure dome capable of withstanding hydrostatic pressure at depth;

a plurality of electrical components mounted to said body and electrically connected with said solenoids for controlling said solenoids, said components being located within said dome;

a dry conduit leading from a communication coupling to the electrical components; and a downwardly extending mandrel for engaging a mating receptacle in said subsea well installation, said mandrel having an upper end located below said electrical components to increase usable space within said subsea control module.

17. The subsea control module according to claim 16 further comprising:

a base plate having a mandrel receptacle adapted to be mounted to said subsea well installation; and a latch mounted to said base plate that latches said mandrel in the mandrel receptacle, said latch being operable independently of said subsea control module.

18. The subsea control module according to claim 16 wherein:

at least one of said connectors comprise an output port for delivering hydraulic fluid pressure to the subsea well installation and wherein at least one filter is upstream of said output port within one of said passageways; and further comprising a check valve incorporated within said filter that allows free flow of fluid out of said subsea control module but filters any returning fluid.

19. The subsea control module according to claim 16 wherein:

at least one of said connectors comprises an output port for delivering hydraulic fluid pressure to the subsea well installation and wherein at least one filter is upstream of said output port within one of said passageways;

wherein said filter comprises:

a check valve in a central passageway that permits flow out of said subsea control module but filters any returning fluid; and a filter element that surrounds said central passageway for filtering said returning fluid.

20. The subsea control module according to claim 16 wherein:

each of said receptacles has a receptacle axis that is substantially perpendicular to the longitudinal axis; and wherein some of the receptacles are located at different elevations along the longitudinal axis than other of said receptacles.

21. A subsea control module comprising:

a valve module having a plurality of cartridge valve receptacles, and a plurality of integral passageways that communicate with said cartridge valve receptacles;

a plurality of cartridge valves in said cartridge valve receptacles wherein said cartridge valves are exposed when said subsea control module is assembled so that said cartridge valves are capable of being removed from the subsea control module from an exterior of the module;

a plurality of solenoids in communication with said integral passageways for selectively providing said cartridge valves with pilot pressure;

a dry nitrogen filled pressure dome affixed to a top of said valve module, said pressure dome capable of withstanding pressure at depth;

a base module affixed to an underside of said valve module, said base module having a dry conduit that wires pass through and a plurality of ports for receiving at least one communication coupling, at least one hydraulic fluid output, and at least one incoming hydraulic source; and at least one filter upstream of an outgoing port that allows free flow of fluid out of said subsea control module but filters any returning fluid.

22. The subsea control module according to claim 21 wherein:

said passageways include a vent port, an output port, and a supply port.

23. The subsea control module according to claim 21 wherein:

said nitrogen in said pressure dome is at a pressure of one atmosphere.

24. The subsea control module according to claim 21 wherein:

said pressure dome is elliptical in shape.

25. The subsea control module according to claim 21 wherein:

said pressure dome hemispherical in shape.

26. The subsea control module according to claim 21 wherein:

said cartridge valve receptacles are perpendicular to an axis of the subsea control module.

27. The subsea control module according to claim 21 wherein:

said cartridge valves are perpendicular to an axis of the subsea control module.

28. The subsea control module according to claim 21 wherein said filter comprises:

a check valve in a central passageway that permits flow out of said subsea control module but filters any returning fluid; and a filter element that surrounds said central passageway for filtering said returning fluid.

* * * * *